United States Patent [19]

King et al.

[11] Patent Number: 5,073,096

[45] Date of Patent: Dec. 17, 1991

[54] FRONT-DISCHARGE FLUID END FOR RECIPROCATING PUMP

[75] Inventors: Randall K. King, Duncan; John R. Wells, Comanche, both of Okla.

[73] Assignee: Halliburton Company, Duncan, Okla.

[21] Appl. No.: 595,348

[22] Filed: Oct. 10, 1990

[51] Int. Cl.[5] ..... F04B 21/02

[52] U.S. Cl. ..... 417/454; 417/570; 137/516.29

[58] Field of Search ..... 417/454, 559, 569, 570, 417/571, 238; 137/516.29; 251/332, 357

[56] References Cited

U.S. PATENT DOCUMENTS

| | | | |
|---|---|---|---|
| 1,546,596 | 7/1925 | Mader . | |
| 2,733,664 | 2/1956 | Saalfrank | 103/153 |
| 2,841,092 | 7/1958 | Whiteman et al. | 103/153 |
| 2,931,313 | 4/1960 | Hughes | 103/178 |
| 3,346,008 | 10/1967 | Scaramucci | 137/516.29 |
| 3,373,695 | 3/1968 | Yohpe | 103/153 |
| 3,801,234 | 4/1974 | Love et al. | 417/569 |
| 3,817,663 | 6/1974 | Zehner | 417/569 |
| 4,099,894 | 7/1978 | Indra | 417/499 |
| 4,477,236 | 10/1984 | Elliott | 417/454 |
| 4,508,133 | 4/1985 | Hamid | 137/68 R |
| 4,520,837 | 6/1985 | Cole et al. | 137/68 R |
| 4,729,401 | 3/1988 | Raines | 137/512 |
| 4,771,801 | 9/1988 | Crump et al. | 137/8.1 |

OTHER PUBLICATIONS

Halliburton Services Sales & Service Catalog No. 43, pp. 2414–2415, Published in 1985.

*Primary Examiner*—Richard A. Bertsch
*Assistant Examiner*—Charles Freay
*Attorney, Agent, or Firm*—James R. Duzan; Neal R. Kennedy

[57] ABSTRACT

A front-discharge fluid end for a reciprocating pump. The fluid end is distinguished by an outlet valve which is positioned substantially coaxially with the pump plunger and generally facing a longitudinally outer end thereof. The outlet valve is held in place by a valve retainer which includes an outlet port and is connectable to an outlet line. For retrofitting prior pump cylinders, a plug assembly is disclosed for plugging the original outlet valve pocket.

17 Claims, 2 Drawing Sheets

FRONT-DISCHARGE FLUID END FOR RECIPROCATING PUMP

BACKGROUND OF THE INVENTION

1. Field Of The Invention

This invention relates to high pressure reciprocating plunger-type and piston-type pumps used in the petroleum industry, and more particularly, to such a pump having a discharge valve positioned substantially coaxially with respect to the pump plunger.

2. Description of the Prior Art

It is common practice in the petroleum industry to employ high pressure plunger-type pumps in a variety of field operations relating to oil and gas wells, such as cementing, acidizing and fracturing, among others. An example of such a high pressure pump is the Halliburton Services HT-400 horizontal triplex pump manufactured by Halliburton Services of Duncan, Okla. These pumps are frequently used in pumping two-phase slurries. Two-phase slurries are those in which solid particles (the "solid phase") are suspended in a liquid (the "liquid phase"). A problem with pumping such two-phase slurries is that the solid phase particles can separate out of the carrier liquid and can collect in valves, elbows, and in the fluid ends of the high pressure pumps in the system.

In the pumps, these particles tend to become packed ahead of the pump plunger or piston. This can result in sudden overpressuring of the fluid in the pump with resulting damage to one or more of the plunger, connecting rod, crankshaft, fluid end, valves or other parts of the pump drive train.

One solution to the overpressuring problem is disclosed in U. S. Pat. No. 4,508,133 to Hamid, assigned to the assignee of the present invention. This invention comprises a protective cover assembly including a substantially circular cover having a shear disc surrounded by an annular outer portion, mounted in a cylinder in the fluid end of the plunger-type high pressure pump. An arcuate boundary of reduced wall thickness is between the shear disc and the outer portion of the cover. The cover is held in place by a retainer assembly which is secured to the fluid end, which retainer assembly includes a plug at the outer end of the retainer. When a predetermined force is generated by the plunger and the cylinder, such as in an overpressure situation, the shear disc of the cover shears and is propelled outwardly against the plug. In turn, this forces the impact disc against an edge of a circular recess in the outer end of the retainer. The impact disc, in shearing against the recess edge, safely dissipates the kinetic energy of the shear disc, while the pressure in the cylinder vents to the atmosphere, avoiding damage to the fluid end of the pump, the plunger, connecting rod, crankshaft, etc.

U. S. Pat. No. 4,520,837 to Cole et al., also assigned to the assignee of the present invention, discloses a protective cover with a shear disc essentially the same as in Hamid, but also includes a more simple, one-piece cover retainer inserted behind the protective cover.

One problem with the apparatus of Hamid and Cole et al. is that the shear disc is subjected to cyclic loading. The cyclic stress causes fatigue and premature failure of the disc around the thin arcuate wall may occur even at low pump pressures. Another problem is that the thin area around the arcuate portion does not leave much thickness for corrosion allowance, and thus may fail prematurely when corrosion is present. A further problem with the previous apparatus is that the shear disc is expensive to fabricate, and machining may leave machine marks which act as stress risers and compound the fatigue problem already mentioned.

An apparatus which solves the fatigue problem is disclosed in U. S. Pat. No. 4,771,801 to Crump et al., also assigned to the assignee of the present invention. In this invention, a cover with a convex or domed center portion is used and is adapted for buckling away from the pump plunger when the pressure in the pump exceeds a predetermined level. The convex portion buckles when excessive force is transmitted from the plunger through any packed solid particles, allowing the packed particles to be pushed through vent passages.

Even though the apparatus of Crump et al. greatly reduces the risk of fatigue failure over Hamid and Cole et al., all three have two additional problems. First, once failure has occurred, the pump must be taken out of service immediately upon rupture of the protective cover. Secondly, a large quantity of the pump fluid can be spilled out of the pump when the cover ruptures. This limits the suitability of the apparatus for pumping some hazardous fluids. Also, the use of such shear discs obviously adds somewhat to the operating costs of the pump in which they are employed.

The pump fluid end of the present invention solves the problems of the prior art by providing a pump in which a discharge valve is placed coaxially with the pump plunger or piston so that, if solid particles become packed ahead of the plunger, the force is transmitted through the particles to the discharge valve, pushing the valve open. This allows the packed particles to be pushed through the valve opening into the discharge passage. During this process, the pump may remain in use, and all fluids remain contained within the pump and its associated plumbing. The pressure containing envelope of the pump contains no designed in "weak links" which present the possibility of failing and spilling fluid, as is possible in the prior art.

SUMMARY OF THE INVENTION

The pump fluid end of the present invention is designed for a high pressure plunger pump, such as used in the petroleum industry for pumping two-phase slurries. The pump fluid end comprises housing means for forming a cylinder having a plunger bore therein and defining an outlet valve pocket at an end of the cylinder and also defining an inlet valve pocket, plunger means for reciprocating within the cylinder, inlet valve means disposed in the inlet valve pocket for allowing a portion of the slurry to enter the cylinder, and outlet valve means disposed in the outlet valve pocket for allowing the slurry to be discharged from the cylinder in response to movement of the plunger means. The outlet valve means generally faces an end of the plunger means. Preferably, the outlet valve pocket is positioned substantially coaxially with respect to the cylinder, and the inlet valve pocket is substantially transverse with respect to the cylinder. A sealing means is provided between the plunger means and the housing means.

The pump fluid end further comprises a retainer means for retaining the outlet valve mean in the outlet valve pocket. The retainer means preferably defines an outlet opening therein which is substantially coaxial with the outlet valve pocket.

The outlet valve means may comprise a seat carrier disposed in the outlet valve pocket and an outlet valve assembly disposed adjacent to the seat carrier. A seat portion of the outlet valve assembly is disposed in the seat carrier. The retainer means preferably clampingly engages both the outlet valve assembly and the seat carrier.

A sealing means for sealing between the seat carrier and the cylinder and between the outlet valve assembly and the seat carrier may be provided.

In the event that solid phase particles separate out of the slurry and tend to be packed in the cylinder adjacent to the plunger means, the positioning of the outlet valve means at the end of the plunger bore in the cylinder allows the particles to be forced through the outlet valve by the plunger.

It is an important object of the present invention to provide a front-discharge fluid end for a reciprocating pump which provides relief for overpressure in the pump due to separation of solid particles from the pumped fluid.

Another object of the invention is to provide a pump fluid end having an outlet valve means disposed at an end of the pump fluid end and generally facing an end of a plunger means reciprocably disposed therein.

It is an additional object of the invention to provide a pump fluid end with a discharge opening substantially coaxial with the pump piston or plunger.

Additional objects and advantages of the invention will become apparent as the following detailed description of the preferred embodiment is read in conjunction with the drawings which illustrate such preferred embodiment.

DETAILED DESCRIPTION OF THE PREFERRED EMBODIMENT

Figure 1:
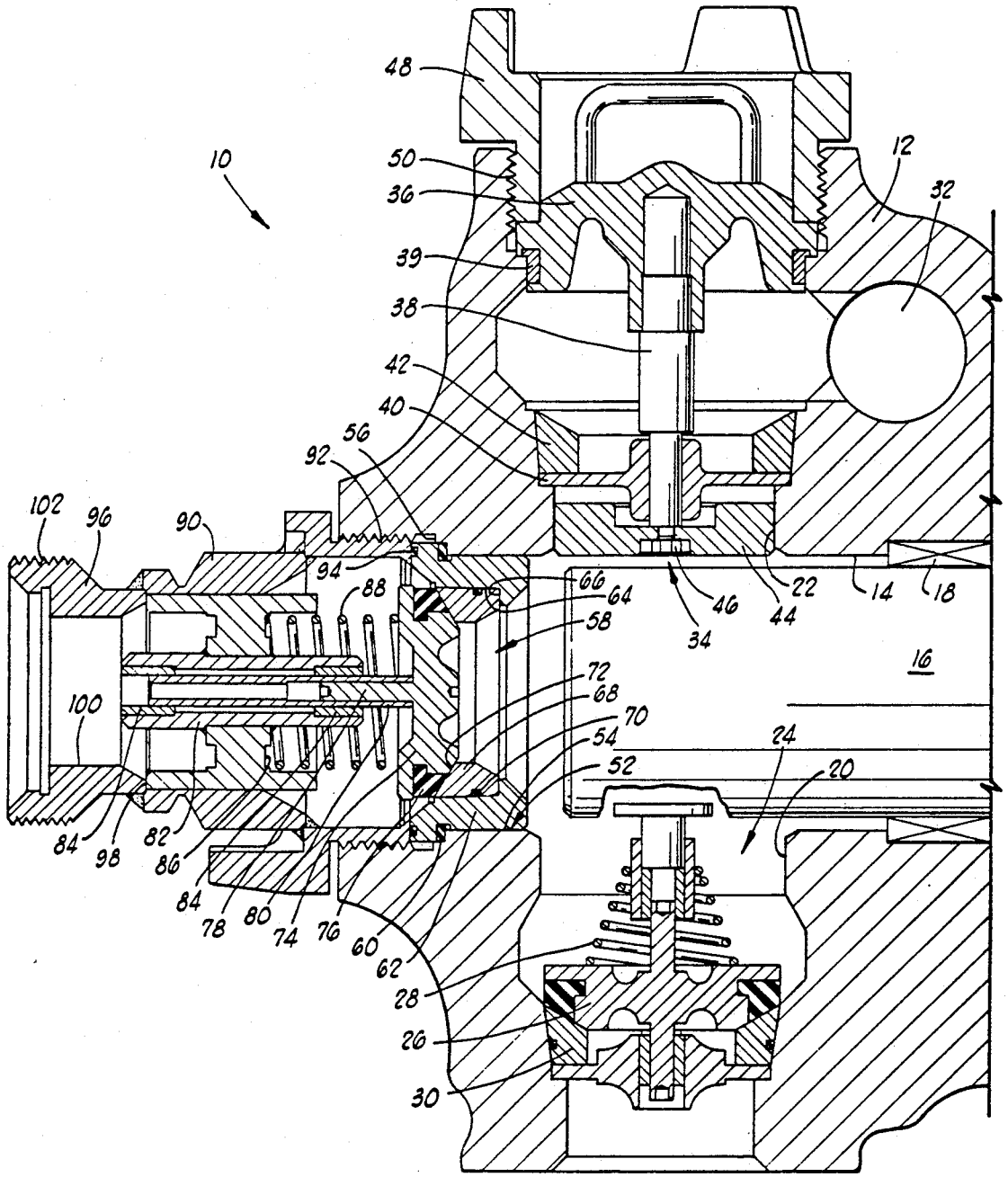
FIG. 1 is a vertical cross section of a portion of the front-discharge fluid end for reciprocating pump of the present invention.

Referring now to the drawings, and more particularly to FIG. 1, an embodiment of the front-discharge fluid end for reciprocating pump of the present invention is shown and generally designated by the numeral 10. The invention may also be referred to hereinafter as apparatus 10.

Apparatus 10 comprises a housing means for forming a cylinder 12 defining a plunger bore 14 therein. A plunger means, such as pump plunger 16, is reciprocably disposed in bore 14 in a manner known in the art. A sealing means also known in the art, such as packing 18, provides sealing engagement between cylinder 12 and plunger 16. The pump typically has a plurality of plunger bores 14 in cylinder 12, such as in the HT-400 horizontal triplex pump previously mentioned. Cylinder 12 as shown in FIG. 1 is substantially the same as the cylinders shown in the prior art patents discussed above, and includes first and second transverse pockets 20 and 22 which are in communication with bore 14. First pocket 20 is used as an inlet valve pocket 20 which has an inlet valve assembly 24 disposed therein. Inlet valve assembly 24 is known in the art and includes an inlet valve 26 biased by a spring 28 against a valve seat 30.

In prior art pumps, second pocket 22 is used as an outlet valve pocket in communication with an original outlet port 32 of the pump. However, in the present invention, second pocket 22 and outlet port 32 are not used, and second pocket 22 (the original outlet valve pocket) is closed by a plug means, such as plug assembly 34.

Plug assembly 34 comprises a cover 36 with a stem 38 extending therefrom. Disposed around stem 38 is a retainer disc 40. A seat 42 is positioned adjacent to retainer disc 40. Below retainer disc 40 is a plug 44 which sealingly engages second pocket 22 adjacent to plunger bore 14. A fastening means, such as nut 46, is used to attach plug 44 to stem 38.

A cover retainer 48 is engaged with cylinder 12 at threaded connection 50. It will thus be seen that cover retainer 48 holds plug assembly 34 in place. Cover retainer 48 is substantially identical to the cover retainer used to hold the discharge valve in place in the prior art pumps previously discussed.

Figure 2:
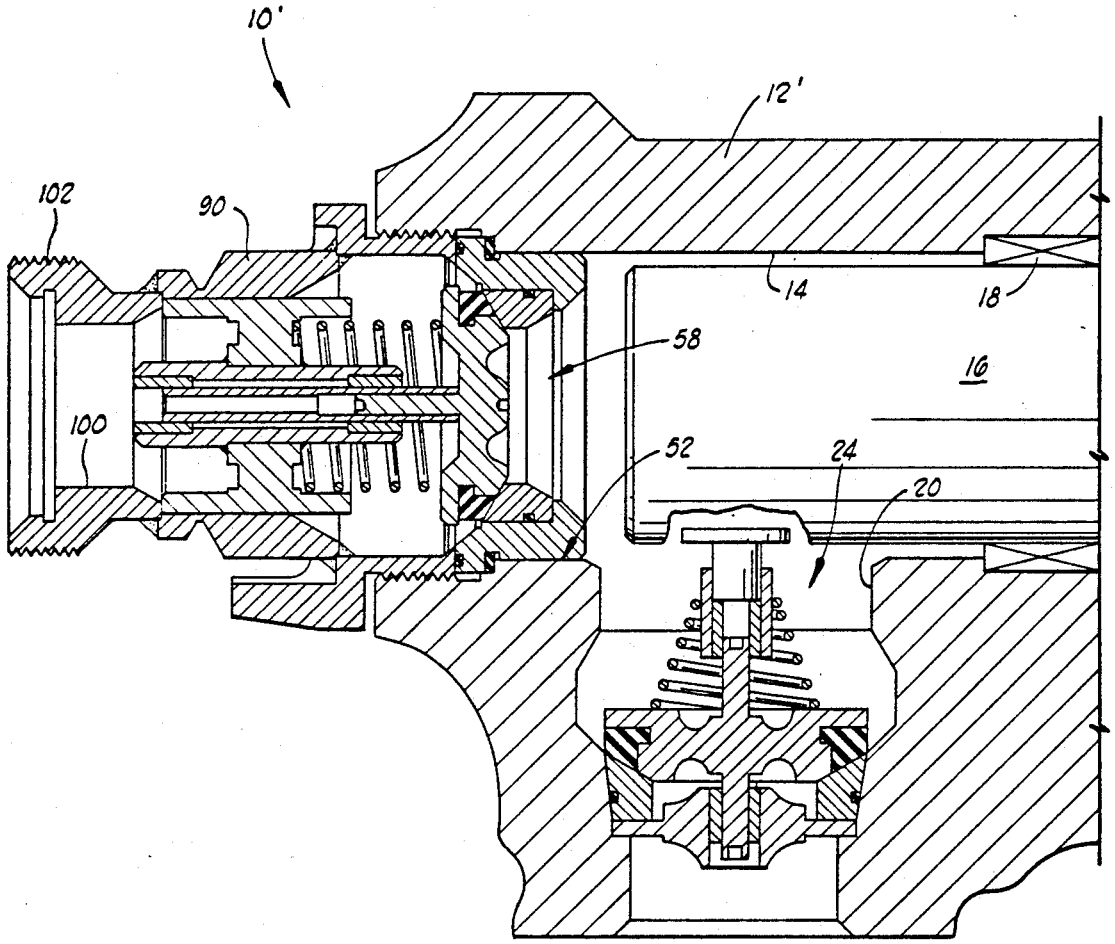
FIG. 2 shows an alternate embodiment of the invention.

Plug assembly 34, or some other plug means, is necessary to close off second pocket 22 when cylinder 12 is of the kind known in the art. That is, plug assembly 34 is used when retrofitting older pumps to the configuration of the present invention. However, since second pocket 22 is not used, it can be eliminated entirely in new equipment. Referring now to FIG. 2, an alternate embodiment 10′ of the present invention is shown. In this embodiment, a body 12′ is used which has a plunger bore 14 and a first pocket 20. However, cylinder 12′ does not include a second pocket. Other than this distinction, first embodiment 10 and alternate embodiment 10′ are identical.

Referring again to FIG. 1, at the longitudinally outer end of plunger bore 14 in cylinder 12 is a third pocket 52 formed by a bore 54 with an outwardly facing shoulder 56 at one end thereof. Bore 54 may be simply an extension of plunger bore 14, but the invention is not intended to be so limited. An outlet or discharge valve assembly 58 is disposed in third pocket 52.

Outlet valve assembly 58 is adjacent to a seat carrier 62 which extends into bore 54. A sealing means, such as valve gasket 60 provides sealing engagement between seat carrier 62 and body 12 adjacent to shoulder 56. Seat carrier 62 defines a bore 64 therein with an annular shoulder 66 at one end thereof.

Outlet valve assembly 58 comprises a valve seat 68 which is disposed in bore 64 of seat carrier 62 adjacent to shoulder 66. A sealing means, such as 0-ring 70, provides sealing engagement between seat 68 and seat carrier 62. Alternately, seat 68 and seat carrier 62 may be a single piece seat without 0-ring 70. Seat 60 may be a taper 72 therein.

A valve member 74 is positioned adjacent to taper 72 in seat 68, and a sealing means, such as valve insert 76, provides sealing engagement between valve 74 and seat 68 when discharge valve assembly 58 is in the closed position shown in FIG. 1.

Valve 74 has an elongated guide portion 78 which is disposed in a sleeve-like valve stem 80. Valve stem 80 is slidably supported in a sleeve-like bushing retainer 82 by a pair of bushings 84. Bushings 84 are preferably of an elastomeric material. Bushing retainer 82 is shown as a weldment made of two pieces, but can easily be formed as an integral part.

Bushing retainer 82 has an annular shoulder 86 thereon. A valve spring 88 is disposed between shoulder 86 and valve 74, and thus provides a biasing means for biasing valve 74 toward the closed position shown.

A retainer means, such as valve retainer 90, is connected to cylinder 12 at threaded connection 92 and bears against a longitudinally outer end of seat carrier 62. A sealing means, such as 0-ring 94, provides sealing engagement between valve carrier 90 and seat carrier 62. It will be seen that seat carrier 62 is thus clamped in place by valve retainer 90.

In the embodiment shown, valve retainer 90 is shown as a weldment having several parts including an outer portion 96. It should be understood that valve retainer 90 can also be integrally made of one piece. Outer portion 96 bears against a longitudinally outer end 98 of bushing retainer 82. It will thus be see that bushing retainer 82 is held in the position shown in FIG. 1 by spring 88 and outer portion 96 of valve retainer 90. In other words, outlet valve assembly 58 is clamped in place.

In an alternate embodiment, valve retainer 90 and bushing retainer 82 may be a single piece.

In outer portion 96 of valve retainer 90 an outlet port 100 may be defined. The outlet port alternately may be in cylinder 12. Outer portion 96 has an external thread 102 thereon. Thread 102 is adapted for being threadingly engaged with an outlet line of a kind known in the art. Thus, it will be seen that the outlet of fluid end 10 is defined in discharge valve retainer 90.

OPERATION OF THE INVENTION

In normal pump operation, fluid enters bore 14 in cylinder 12 through inlet valve assembly 24 as a result of the withdrawal of plunger 16 from the cylinder, after which the fluid in cylinder 12 is raised in pressure by the advance of plunger 16 toward outlet valve assembly 58. The fluid is then discharged from bore 14 through outlet valve assembly 58. Because outlet valve assembly 58 is substantially coaxial with plunger 16, any particles which have separated from the slurry being pumped are simply pushed through the outlet valve into outlet port 100, and then out of the pump. This is not possible in the prior art pumps wherein the discharge valve assembly is substantially perpendicular to the pump plunger. Thus, apparatus 10 of the present invention allows for solid particle separation in the pumped slurry while eliminating the problems associated with prior art pumps with rupture discs.

It can be seen, therefore, that the front-discharge fluid end for reciprocating pump of the present invention is well adapted to carry out the ends and advantages mentioned as well as those inherent therein. While presently preferred embodiments of the apparatus have been shown for the purposes of this disclosure, numerous changes in the arrangement and construction of parts may be made by those skilled in the art. All such changes are encompassed within the scope and spirit of the appended claims.

What is claimed is:

1. A pump fluid end for a plunger pump used for pumping two-phase slurries, said pump fluid end comprising:

housing means for forming a cylinder having a plunger bore therein and defining an outlet valve pocket at an end of said cylinder, said outlet valve pocket having an annular shoulder therein, said housing means also defining an inlet valve pocket;

plunger means for reciprocating within said cylinder;

inlet valve means disposed in said inlet valve pocket for allowing a portion of the slurry to enter said cylinder;

outlet valve means disposed in said outlet valve pocket and generally facing an end of said plunger means for allowing said portion of said slurry to be discharged from said cylinder in response to movement of said plunger means, said outlet valve means comprising:

a seat carrier disposed in said outlet valve pocket and having a portion adjacent to said shoulder in said outlet valve pocket, said seat carrier defining a central opening therethrough and having a seat carrier shoulder therein; and an outlet valve assembly disposed in said central opening of said seat carrier adjacent to said seat carrier shoulder; and retainer means for engaging said seat carrier and clamping said seat carrier toward said shoulder in said outlet valve pocket and for engaging said outlet valve assembly and clamping said outlet valve assembly toward said seat carrier shoulder.

2. The pump fluid end of claim 1 wherein said retainer means defines an outlet opening therein.

3. The pump fluid end of claim 2 wherein said outlet opening is substantially co-axial with said outlet valve pocket.

4. A pump fluid end for a plunger pump used for pumping two-phase slurries, said pump fluid end comprising:

housing means for forming a cylinder having a plunger bore therein and defining an outlet valve pocket at an end of said cylinder, said outlet valve pocket having an annular shoulder therein, said housing means also defining an inlet valve pocket;

plunger means for reciprocating within said cylinder;

inlet valve means disposed in said inlet valve pocket for allowing a portion of the slurry to enter said cylinder;

outlet valve means disposed in said outlet valve pocket and generally facing an end of said plunger means for allowing said portion of said slurry to be discharged from said cylinder in response to movement of said plunger means, said outlet valve means comprising:

a seat carrier disposed in said outlet valve pocket and having a portion adjacent to said shoulder in said outlet valve pocket, said seat carrier defining a central opening therethrough and having a seat carrier shoulder therein; and an outlet valve assembly disposed in said central opening of said seat carrier adjacent to said seat carrier shoulder;

retainer means for engaging said seat carrier and clamping said seat carrier toward said shoulder in said outlet valve pocket and for engaging said outlet valve assembly and clamping said outlet valve assembly toward said seat carrier shoulder; and sealing means for sealing between said seat carrier and said outlet valve assembly pocket and sealing between said outlet valve assembly and said seat carrier.

5. The apparatus of claim 4 wherein said sealing means comprises:

a gasket disposed between said portion of said seat carrier and said shoulder in said outlet valve pocket; and a seal disposed between said outlet valve and said central opening in said seat carrier.

6. The apparatus of claim 4 further comprising another sealing means for sealing between said retainer means and said seat carrier.

7. The apparatus of claim 6 wherein the other sealing means is characterized by an O-ring.

8. The apparatus of claim 4 wherein said retainer means defines an outlet opening therein.

9. The apparatus of claim 8 wherein said outlet valve opening is substantially co-axial with said outlet valve pocket.

10. A pump fluid end for a plunger pump used for pumping two-phase slurries, said pump fluid end comprising:

housing means for forming a cylinder having a plunger bore therein and defining an outlet valve pocket at an end of said cylinder and also defining an inlet valve pocket, said housing means further defining an original outlet valve pocket transverse to said plunger bore;

plunger means for reciprocating within said cylinder;

inlet valve means disposed in said inlet valve pocket for allowing a portion of the slurry to enter said cylinder;

outlet valve means disposed in the first mentioned outlet valve pocket and generally facing an end of said plunger means for allowing said portion of said slurry to be discharged from said cylinder in response to movement of said plunger means; and plug means for closing said original outlet valve pocket.

11. The pump fluid end of claim 10 wherein said outlet valve pocket is substantially coaxial with said cylinder.

12. The pump fluid end of claim 10 wherein said inlet valve pocket is disposed substantially transversely with respect to said cylinder.

13. The pump fluid end of claim 10 further comprising retainer means for retaining said outlet valve means in said outlet valve pocket.

14. The pump fluid end of claim 13 wherein said retainer means defines an outlet opening therein.

15. The pump fluid end of claim 14 wherein said outlet opening is substantially coaxial with said outlet valve pocket.

16. The pump fluid end of claim 13 wherein said outlet valve means comprises:

a seat carrier disposed in said outlet valve pocket; and an outlet valve assembly disposed adjacent to said seat carrier;

wherein, said retainer means clampingly engages said seat carrier and said outlet valve assembly.

17. The pump fluid end of claim 16 further comprising sealing means for sealing between said seat carrier and said outlet valve pocket and sealing between said outlet valve assembly and said seat carrier.

* * * * *